US009345073B1

(12) United States Patent
Tseng et al.

(10) Patent No.: US 9,345,073 B1
(45) Date of Patent: May 17, 2016

(54) LIGHT EMITTING DIODE BULB

(71) Applicant: Lediamond Opto Corporation, New Taipei (TW)

(72) Inventors: Chung-Ting Tseng, New Taipei (TW); Hsuan-Hsien Lee, New Taipei (TW); Peng-Yu Chen, New Taipei (TW)

(73) Assignee: LEDIAMOND OPTO CORPORATION, New Taipei (TW)

( * ) Notice: Subject to any disclaimer, the term of this patent is extended or adjusted under 35 U.S.C. 154(b) by 0 days.

(21) Appl. No.: 14/608,296

(22) Filed: Jan. 29, 2015

(51) Int. Cl.
*H05B 37/00* (2006.01)
*H05B 33/06* (2006.01)
*H05B 33/12* (2006.01)

(52) U.S. Cl.
CPC ..... *H05B 33/06* (2013.01); *H05B 33/12* (2013.01)

(58) Field of Classification Search
CPC ..... H05B 33/06; H05B 33/12
See application file for complete search history.

(56) References Cited

FOREIGN PATENT DOCUMENTS

| | | | |
|---|---|---|---|
| CN | 101876405 | A | 11/2010 |
| CN | 102235588 | A | 11/2011 |
| CN | 102748594 | A | 10/2012 |
| CN | 103527942 | A | 1/2014 |
| CN | 203703681 | U | 7/2014 |
| KR | 1020090115656 | A | 11/2009 |

OTHER PUBLICATIONS

Technical Evaluation Report dated Dec. 15, 2015 of the corresponding China Utility Model patent.

*Primary Examiner* — Tracie Y Green
(74) *Attorney, Agent, or Firm* — Chun-Ming Shih; HDLS IPR Services

(57) ABSTRACT

A light emitting diode bulb includes a driving circuit board, a lighting unit, and a housing. The driving circuit board has one or more extending parts formed on one side, and a group of electrically connecting pins are disposed on the other side. An electrode is attached to one surface of each of the extending parts. The lighting unit is electrically connected to the electrodes. The housing packages the driving circuit board and the lighting unit, the electrically connected pins extend beyond the housing. The light emitting bulb has advantages of easy manufacture and low cost since the driving circuit board is electrically connected to the lighting unit directly and the housing then packages the driving circuit board and the lighting unit.

10 Claims, 15 Drawing Sheets

LIGHT EMITTING DIODE BULB

BACKGROUND OF THE INVENTION

1. Field of the Invention

The present invention relates to light bulb, and in particular to a light emitting diode bulb.

2. Description of Related Art

A light emitting diode is a kind of semiconductor device and has advantage of long service time, with advances in semiconductor packaging technology and the advantage mentioned above, light emitting diode is gradually replacing the fluorescent tubes and incandescent lamps and widely used in indoor and outdoor lighting and vehicle lights.

Reference is made to FIG. 1, which shown a conventional light emitting diode bulb. The light emitting bulb includes a housing 10 having a platform 101 for arranging a substrate 201 mounting light emitting diode 20 thereon. The substrate 201 is electrically connected to at least one light emitting diode die 202. At least one hole 102 allowing wires 203 passing therethrough is formed on the platform 101, the wires 203 are used for electrically connecting the substrate 201 and a circuit board 30 arranged within the accommodating space 103 of the housing 10. A plurality of pins 301 electrically connected to the circuit board 30 extend beyond the housing 10. The light emitting diode bulb further includes a shell 40 assembled with the platform 101 such that the light emitting diode 20 is arranged between the shell 40 and the platform 101. When the pins 301 of the light emitting diode bulb are socketed into a lamp holder, the circuit board 30 drives the light emitting diode 20 to light.

The light emitting diode 20 and the circuit board 30 are respectively arranged on the platform 101 and within the accommodating space 103, and electrically connected to the circuit board 30 via the wires 203, considerable time is spent on assembling the light emitting diode 20, the circuit board 30, and the wires 203, and is expensive.

SUMMARY OF THE INVENTION

It is an object of the present invention to provide a light emitting diode bulb having a driving circuit board in directly electrical connection with lighting unit, where the driving circuit board and the lighting unit are packaged within a housing, so that the light emitting bulb has advantages of easily manufacturing and low cost.

Accordingly, the present invention provides a light emitting diode bulb comprising a driving circuit board, a lighting unit, and a housing. A driving circuit is mounted on the driving circuit board. The driving circuit board comprises one or more extending parts formed at one side thereof and a group of electrically connecting pins disposed on the other side thereof. One or more electrodes are attached to one surface of each of the extending parts. The lighting unit is electrically connected to the electrodes, the housing packages the driving circuit board and the lighting unit, and the electrically connecting pins extending beyond the housing.

In an embodiment of the present invention, the lighting unit comprises a transparent substrate, a circuit layer is attached to one surface of the transparent substrate and electrically connected to a plurality of light emitting diode dies. The circuit layer comprises two or more electrically connecting pads for electrically connecting to the electrodes.

In an embodiment of the present invention, the transparent substrate has two opposite surfaces, one of the surfaces is covered with a first transparent sheet, and the other surface is covered with a second transparent sheet. The electrically connecting pads are exposed out of the first transparent sheet.

In an embodiment of the present invention, a predetermined distance larger than or equal to a width of the lighting unit is between the two extending parts formed on the driving circuit board, the lighting unit is directly inserted between the extending parts, and the electrically connecting pads are electrically connected to the electrodes.

In an embodiment of the present invention, the housing comprises an enclosure and a shell, the enclosure is of U-shape or plate shape and comprises an accommodating space, a group of penetrating holes, and at least one tenon. The accommodating space is used for accommodating the driving circuit board, and the penetrating holes allow the electrically connecting pins passing therethrough. The tenon of hook shape is formed on an inner wall of the enclosure. The shell is of arc shape, cone shape or bullet shape and comprises an inner hollow cavity, the lower edge of the shell comprises at least one ledge, and an engaging part formed on the ledge for engaging with the tenon when the shell is assembled with the enclosure.

In an embodiment of the present invention, the shell is made of plastic or acrylic.

In an embodiment of the present invention, the enclosure is made of plastic or metal.

In an embodiment of the present invention, the housing is of bullet shape and comprises a cylindrical enclosure and a shell of arc, cone, or inverse U-shape extending from the enclosure.

In an embodiment of the present invention, the housing is made of silicone or epoxy.

In an embodiment of the present invention, the housing further comprises a light-diffusing component, and the light-diffusing component is titanium dioxide or silicon dioxide.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

A preferred embodiment of the present invention will be described with reference to the drawings.

Figure 1:
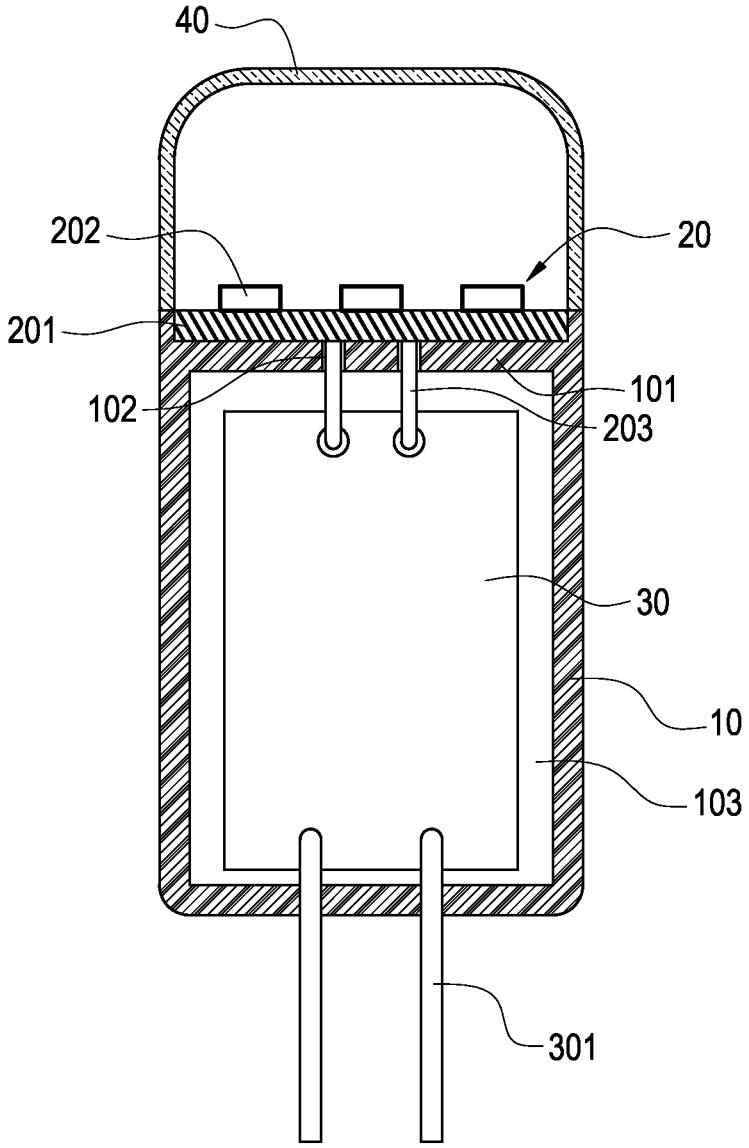
FIG.1 PRIOR ART
FIG. 1 is a sectional view of a conventional light emitting diode bulb.
Figure 2:
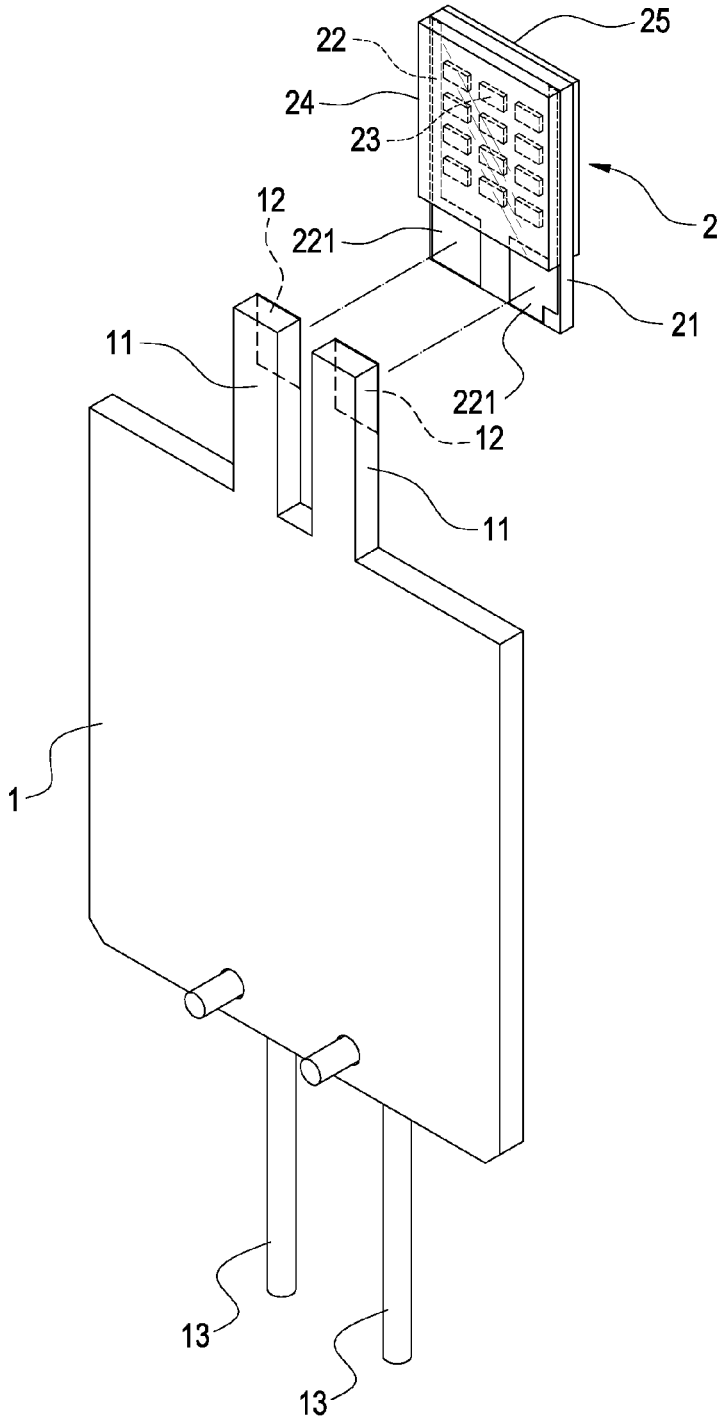
FIG. 2 is an exploded view of a lighting unit and a driving circuit board of a light emitting diode bulb according to a first embodiment of the present invention.
Figure 3:
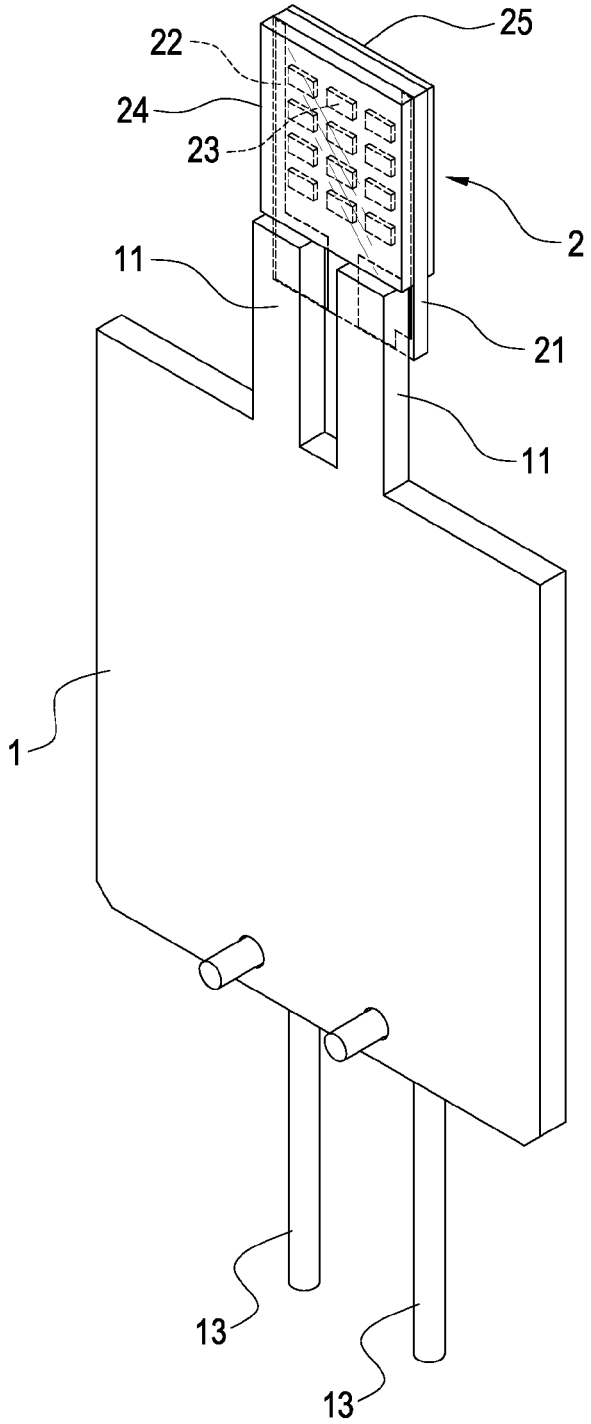
FIG. 3 is an assembled view of the lighting unit and the driving circuit board of the light emitting diode bulb according the first embodiment of the present invention.
Figure 4:
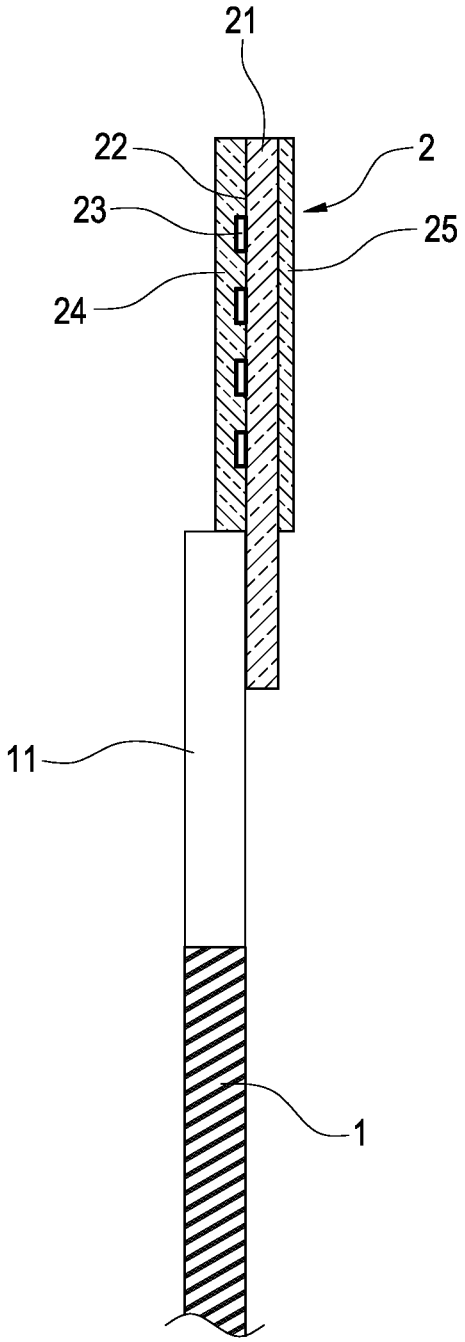
FIG. 4 is a partially-enlarged sectional view of FIG. 3.

Reference is made to FIG. 2, FIG. 3, and FIG. 4, FIG. 2 and FIG. 3 are respectively an exploded view and an assembled view of a lighting unit and a driving circuit board of a light emitting diode bulb according to a first embodiment of the present invention, and FIG. 4 is a partially-enlarged sectional view of FIG. 3. The light emitting diode bulb of the present invention includes a driving circuit board 1 and a lighting unit 2.

The driving circuit board 1 has a driving circuit (not shown) mounted thereon and one or more extending parts of strip shape or slice shape formed at one side thereof. A surface of each of the extending parts 11 has one or more electrodes 12 for electrically connecting to the lighting unit 2 when the lighting unit 2 is assembled with the driving circuit board 1. The driving circuit board 1 has a group of electrically conductive pins 13 at one side opposite to the extending part, and in this embodiment, the driving circuit board 1 includes a pair of electrically conductive pins 13 disposed on the other side opposite to the extending parts 11.

The lighting unit 2 includes a transparent substrate 32. One surface of the transparent substrate 21 has a circuit layer 22 mounted thereon. A plurality of light emitting diode dies 23 are electrically connected to the circuit layer 22. The circuit layer 22 has two or more electrically connecting pads 221 for electrically connecting to the electrodes 12 when the lighting unit 2 is assembled with the driving circuit board 1. The surface of the transparent substrate 21 where the circuit layer 22 is mounted is covered with a first transparent sheet 24. However, the electrically connecting pads 221 are exposed to the first transparent sheet 24 for electrically connecting to the electrodes 12 when the lighting unit 2 is assembled with the extending part 11 of the driving circuit board 1. The other surface of the transparent substrate 21 opposite to the surface where the circuit layer 22 is mounted is covered with a second transparent sheet 25.

Figure 5:
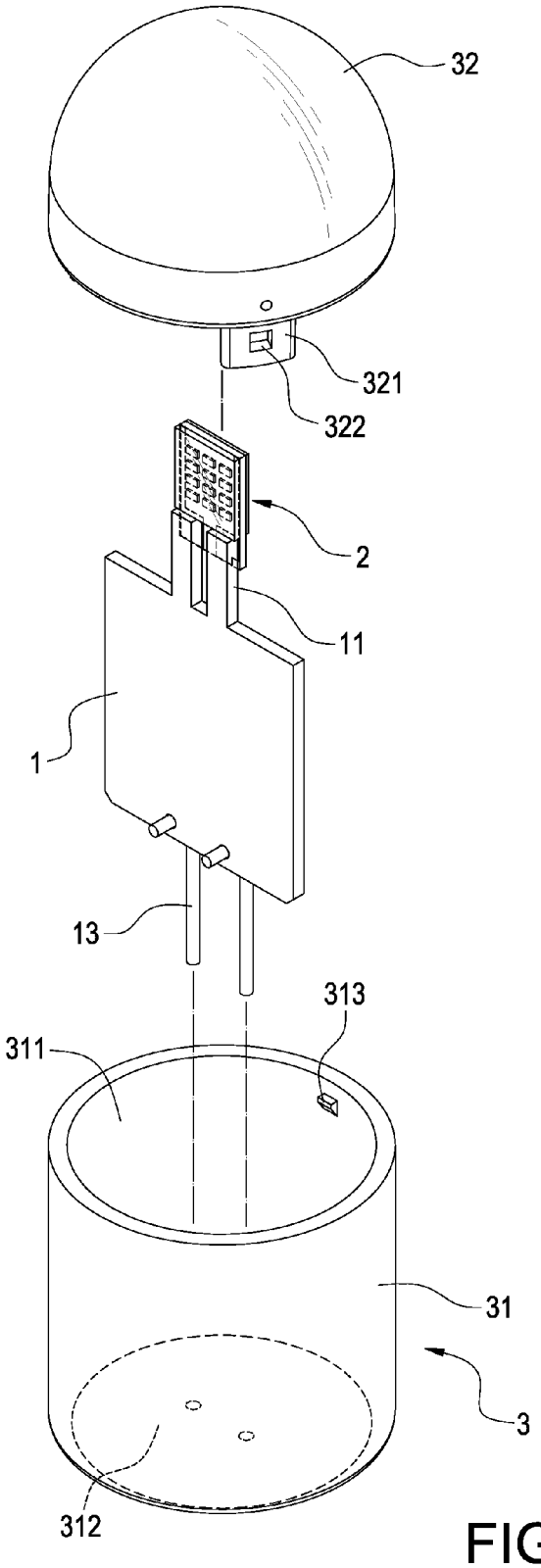
FIG. 5 is an exploded view of the light emitting diode bulb according to the first embodiment of the present invention.
Figure 6:
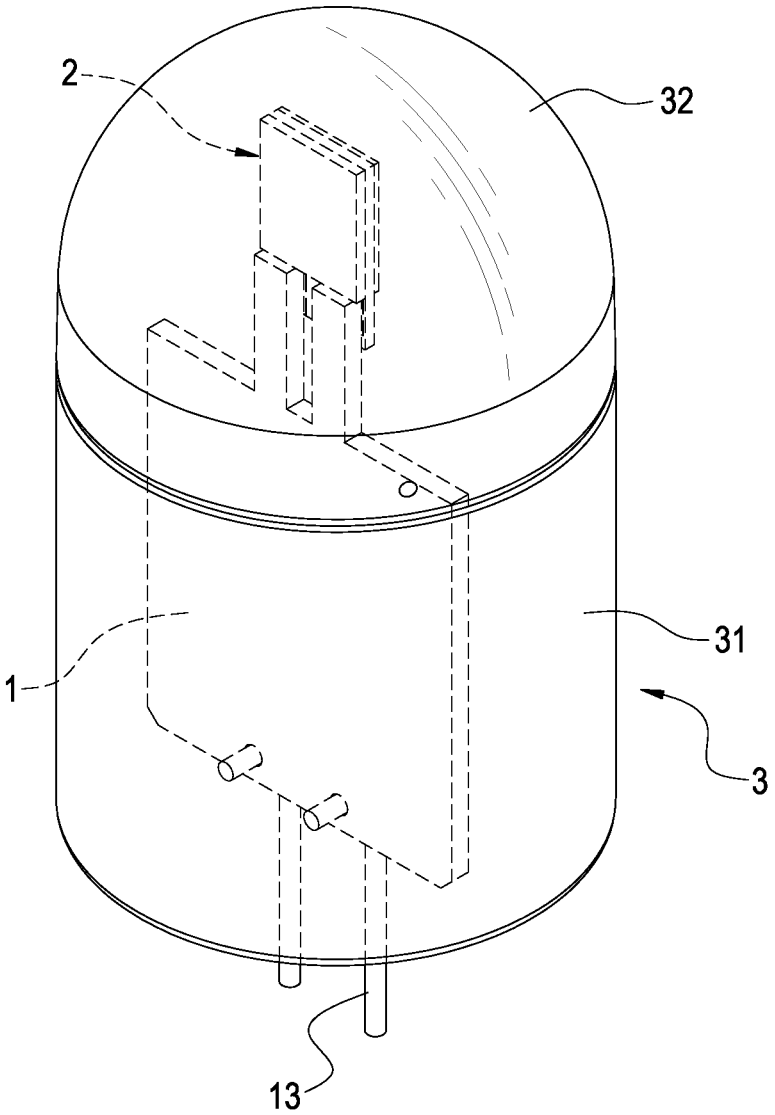
FIG. 6 is a perspective view of the assembled light emitting diode bulb according to the first embodiment of the present invention.
Figure 7:
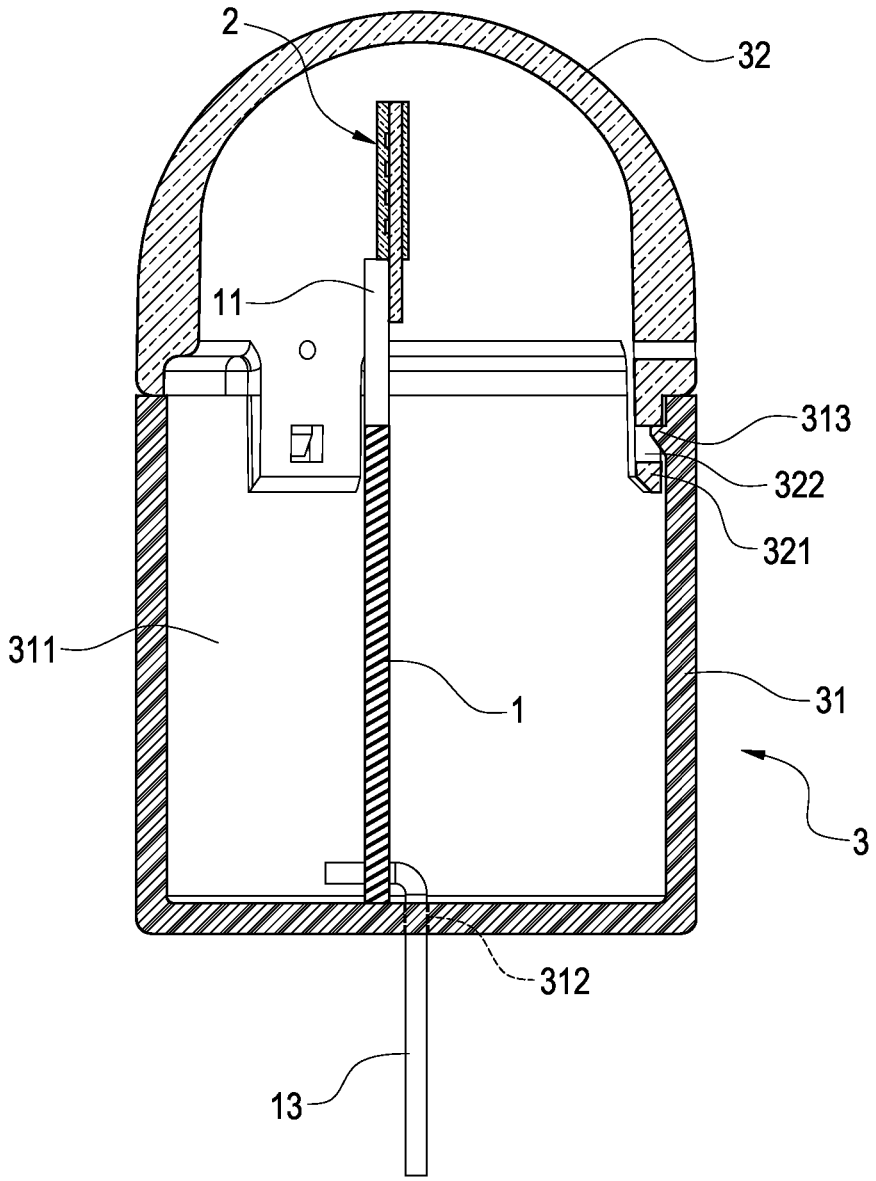
FIG. 7 is a sectional view of the assembled light emitting diode lamp according to the first embodiment of the present invention.

Reference is made to FIG. 5, FIG. 6, and FIG. 7, which are an exploded view, an assembled view, and a sectional view of the light emitting diode bulb according to the first embodiment of the present invention. The light emitting diode bulb further includes a housing 3 for packaging the driving circuit board 1 and the lighting unit 2. The housing 3 is of bullet shape and includes an enclosure 31 and a shell 32.

The enclosure 31 has a U-shape profile. An accommodating space 311 for accommodating the driving circuit board 1 is formed within the enclosure 31. A bottom of the enclosure 31 has a group of penetrating holes 312 allowing the electrically connecting pins 13 passing therethrough, such that the electrically connected pins 13 are adapted into an external socket (not shown). The enclosure 31 further includes at least one tenon 313 of hook shape and used for engaging with the shell 32. In this embodiment, the enclosure 31 is made of plastic or metal.

The shell 32 is of arc shape and has an inner hollow cavity. The lower edge of the shell 32 includes at least one ledge 321, and an engaging part 322 is formed on the ledge 321 for engaging with the tenon 313 when the shell 32 is assembled with the enclosure 31, such that the shell 32 can firmly assembled with the enclosure 31. In this embodiment, the shell 32 is made of plastic (such as polycarbonate, PC) or acrylic (such as polypropylene, PP).

Figure 8:
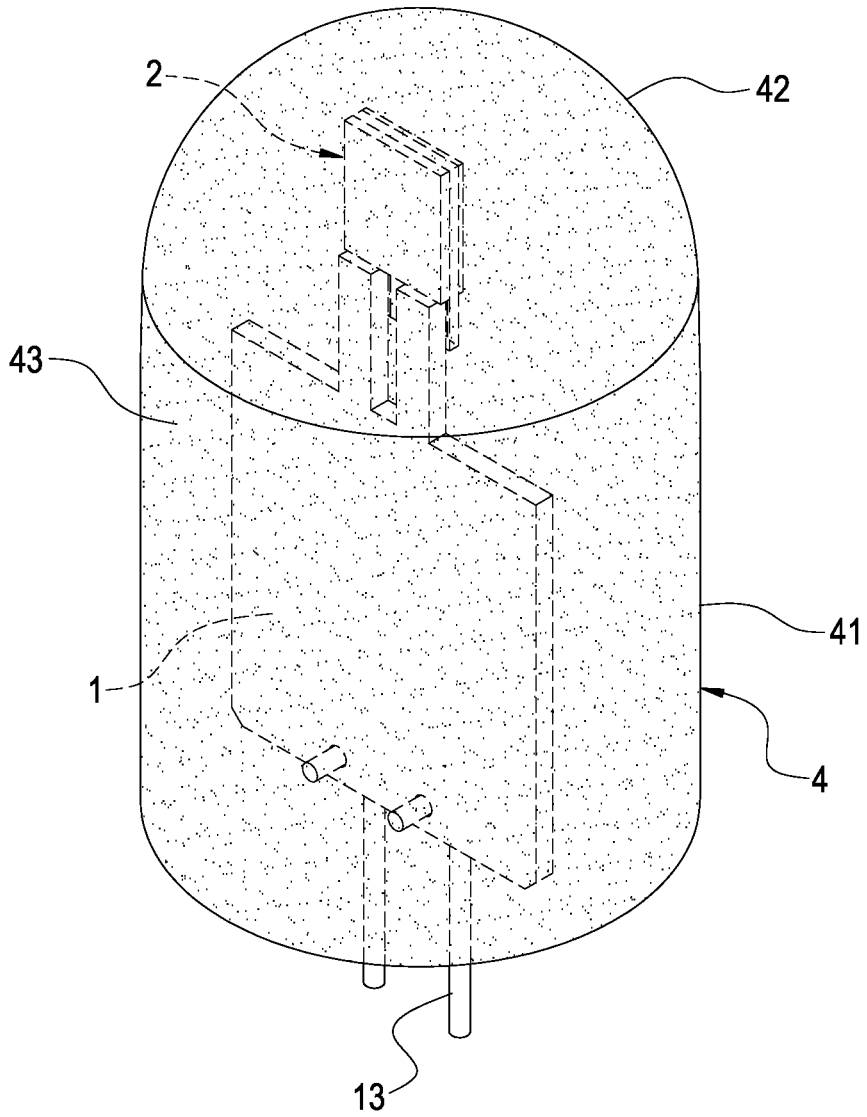
FIG. 8 is a perspective view of a light emitting diode bulb according to a second embodiment of the present invention.

Reference is made to FIG. 8, which is a perspective view of a light emitting diode bulb according to a second embodiment of the present invention. The light emitting diode bulb includes a housing 4. The housing 4 is made of silicone or epoxy, which is added with light-diffusing component 43 and mixed thoroughly. The light-diffusing component 43 is titanium dioxide ($TiO_2$) or silicon dioxide ($SiO_2$). The housing 4 of bullet shape is formed on the driving circuit board 1 and the lighting unit 2 by thermosetting, injection molding, or thermoforming. The housing 4 includes a cylindrical enclosure 41 and a shell 42 of arc, cone, or inverse U-shape extending from the enclosure 41. The light generated from the lighting unit 2 is diffused by the light-diffusing component 43 and then uniformly projects from the housing 4 when the driving circuit board 1 is powered up and the lighting unit 2 is lighted.

Figure 9:
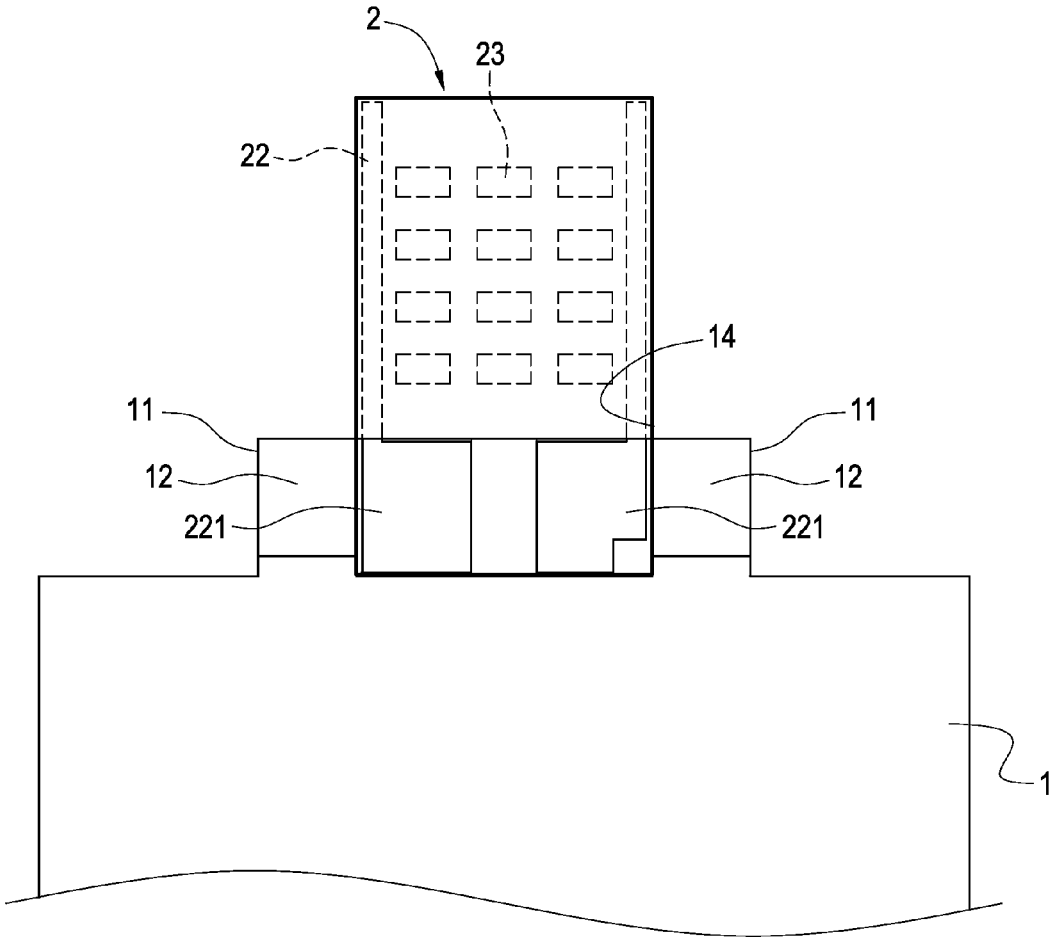
FIG. 9 is an enlarged view of a light emitting diode bulb according to a third embodiment of the present invention.
Figure 10:
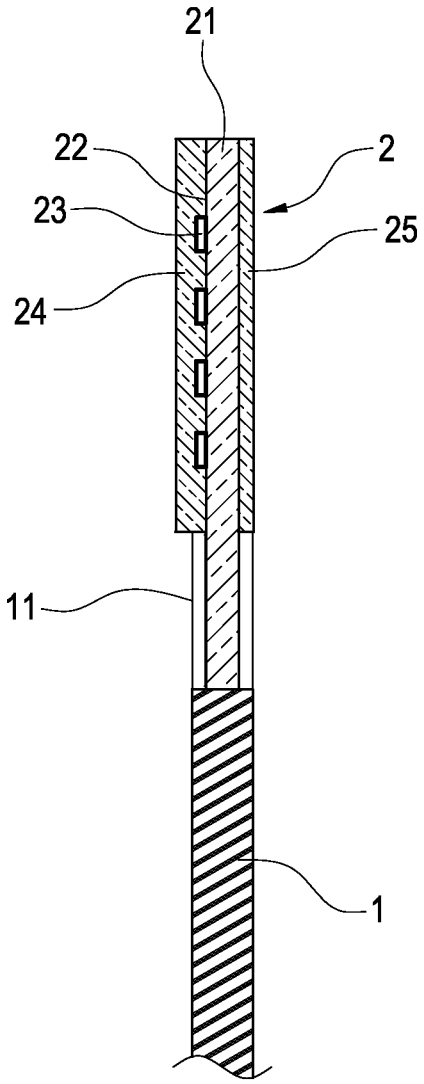
FIG. 10 is a sectional view of the light emitting diode bulb according to the third embodiment of the present invention.

Reference is made to FIG. 9 and FIG. 10, which are an enlarged view and a sectional view of a light emitting diode bulb according to the third embodiment of the present invention. The light emitting bulb is similar to the first embodiment mentioned above. The difference is that a predetermined distance 14 is between two extending parts 11 of the driving circuit board 1. The predetermined distance 14 is larger than or equal to the width of the transparent substrate 21 of the lighting unit 2, such that the transparent substrate 21 of the lighting unit 2 can directly insert between the extending parts 11, the transparent substrate 21 of the lighting unit 2 is fastened with the extending parts 11, and the electrically connecting pads 221 are electrically connected to the electrodes 12. Thereby, the thickness of the assembled driving circuit board 1 and the lighting unit 2 is smaller than that of in the first embodiment, and the process of electrically connecting the driving circuit board 1 and the lighting unit 2 is more convenient than that of in the first embodiment.

Figure 11:
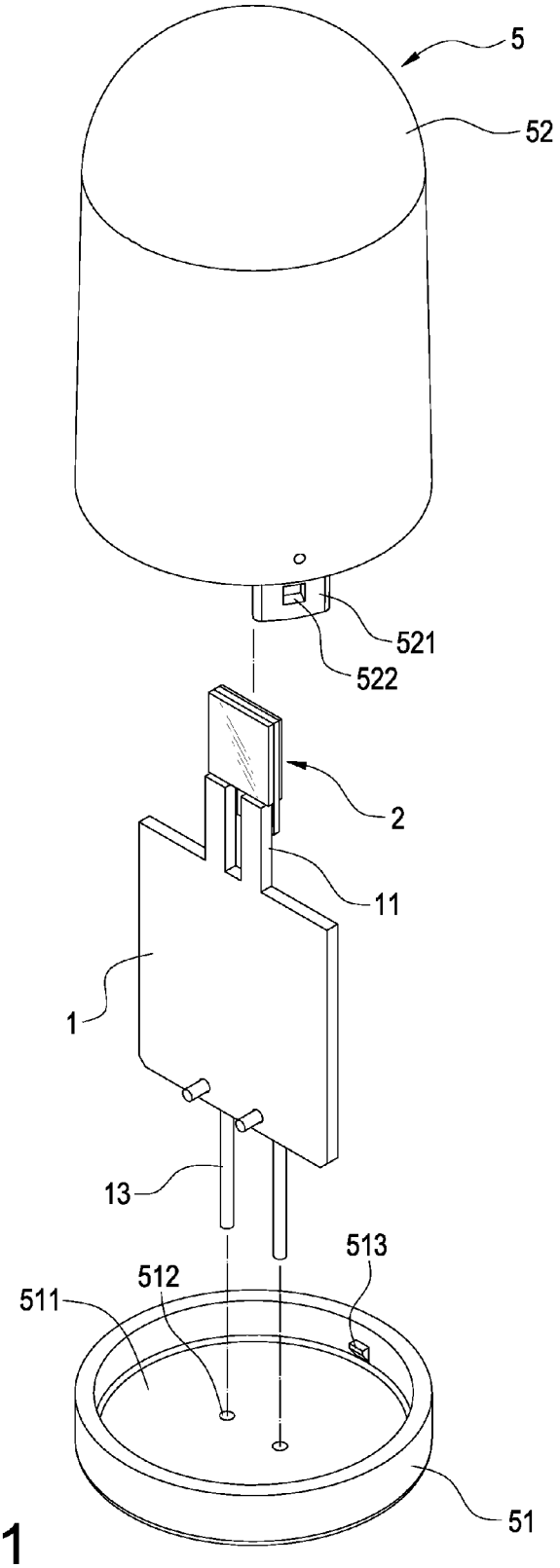
FIG. 11 is an exploded view of a light emitting diode bulb according to a fourth embodiment of the present invention.
Figure 12:
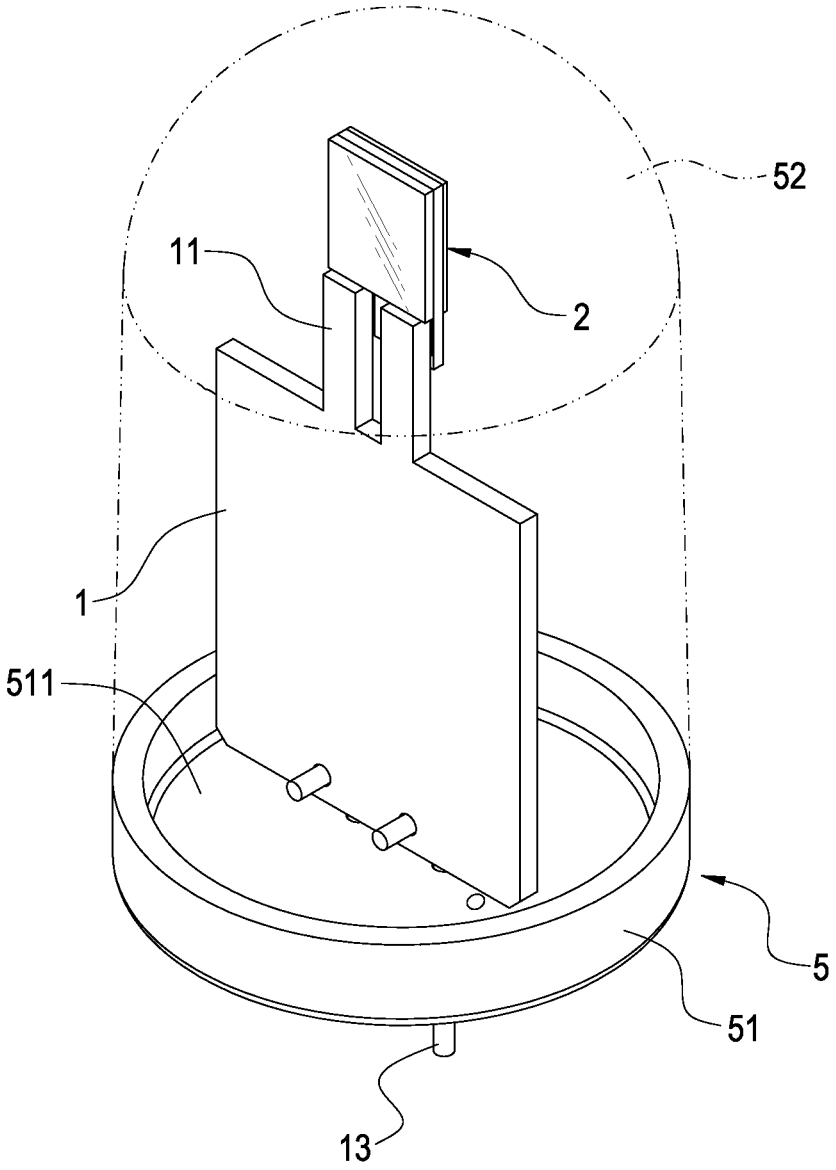
FIG. 12 is a perspective view of the light emitting diode bulb according to the fourth embodiment of the present invention.

Reference is made to FIG. 11 and FIG. 12, which are an explored view and a perspective view of a light emitting diode bulb according to a fourth embodiment of the present invention. The light emitting bulb is similar to the first embodiment mentioned above. The difference is that the housing 5 includes an enclosure 51 and a shell 52, and the profile of the enclosure 51 is of plate shape. The enclosure 51 has an accommodating space 511 for accommodating the driving circuit board 1. The bottom of the enclosure 51 has a group of penetrating holes 512 allowing the electrically connecting pins 13 passing therethrough, such that the electrically connected pins 13 can be adapted into an external socket (not shown). The enclosure 51 further includes at least one tenon 513 of hook shape and used for engaging with the shell 52.

The shell 52 is of bullet shape and has an inner hollow cavity. The lower edge of the shell 52 includes at least one ledge 521, and an engaging part 522 is formed on the ledge 521 for engaging with the tenon 513 when the shell 52 is assembled with the enclosure 51, such that the shell 522 can be firmly assembled with the enclosure 51.

Figure 13:
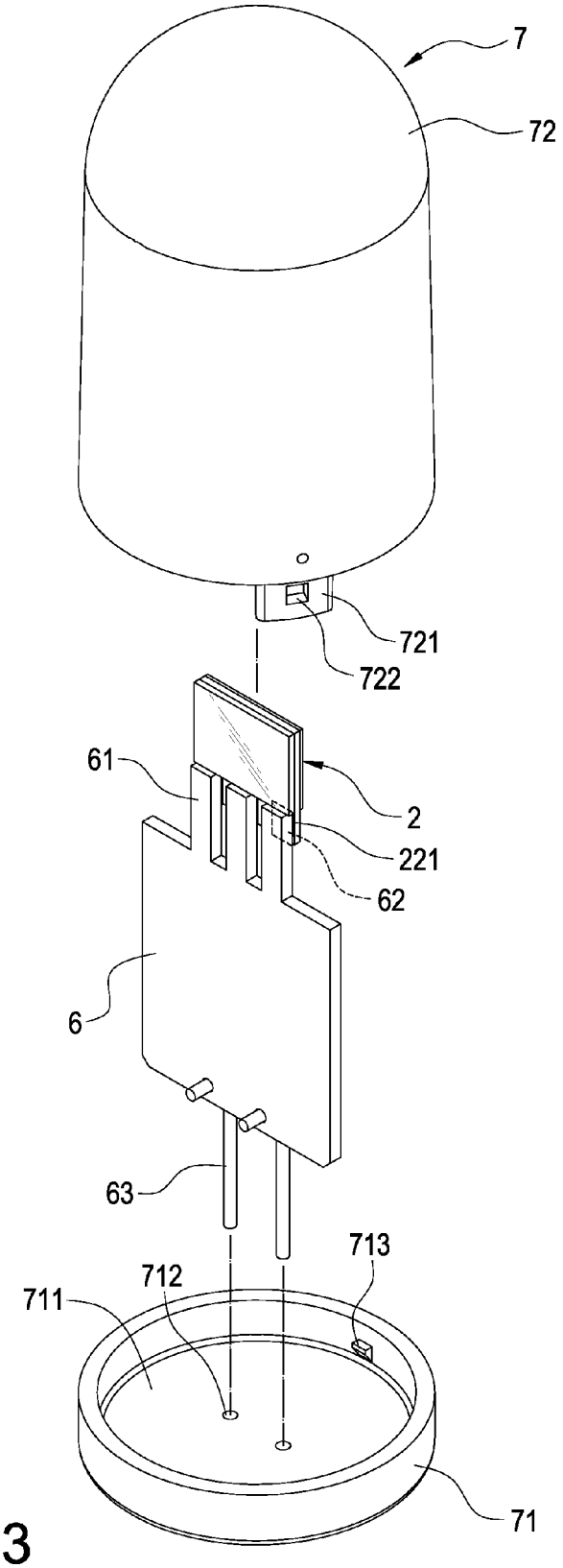
FIG. 13 is an exploded view of a light emitting diode bulb according to a fifth embodiment of the present invention.
Figure 14:
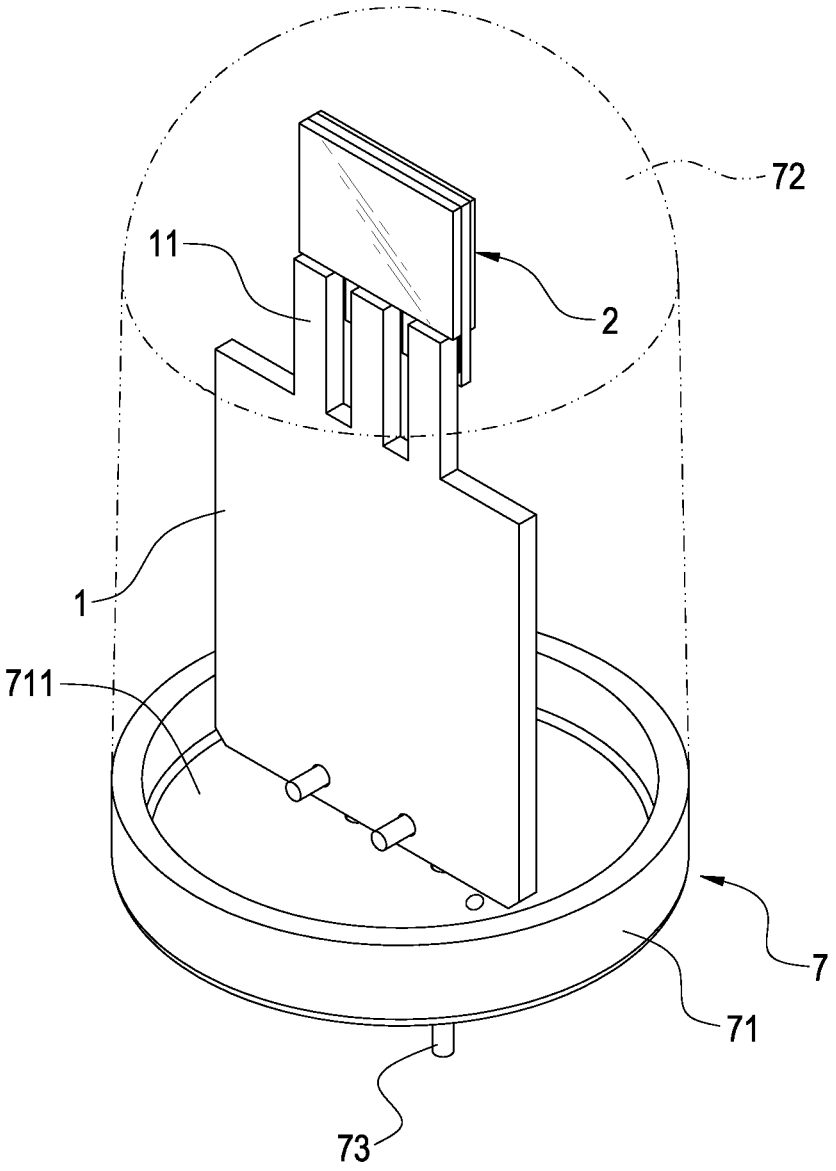
FIG. 14 is a perspective view of the light emitting diode bulb according to the fifth embodiment of the present invention.

Reference is made to FIG. 13 and FIG. 14, which are an exploded view and a perspective view of a light emitting diode bulb according to a fifth embodiment of the present invention. The light emitting bulb is similar to the first embodiment mentioned above. The difference is that the driving circuit board 6 includes three extending parts 61. A surface of each of the extending parts 61 has an electrode 62 for electrically connecting to three electrically connecting pads 221 of the lighting unit 2. The extending parts 61 allow positive electricity and negative electricity selectively transmitting to the lighting unit 2 to switch the light emitting diode dies 23.

The housing 7 includes an enclosure 71 and a shell 72, and the profile of the enclosure 71 is of plate shape. The enclosure 71 has an accommodating space 711 for accommodating the driving circuit board 6. The bottom of the enclosure 71 has a group of penetrating holes 712 allowing the electrically connecting pins 63 of the driving circuit board 6 passing therethrough, such that the electrically connected pins 63 can be adapted into an external socket (not shown). The enclosure 71 further includes at least one tenon 713 of hook shape and used for engaging with the shell 72.

The shell 72 is of bullet shape and has an inner hollow cavity. The lower edge of the shell 72 includes at least one ledge 721, and an engaging part 722 is formed on the ledge 721 for engaging with the tenon 713 when the shell 72 is assembled with the enclosure 71, such that the shell 722 can be firmly assembled with the enclosure 71.

Figure 15:
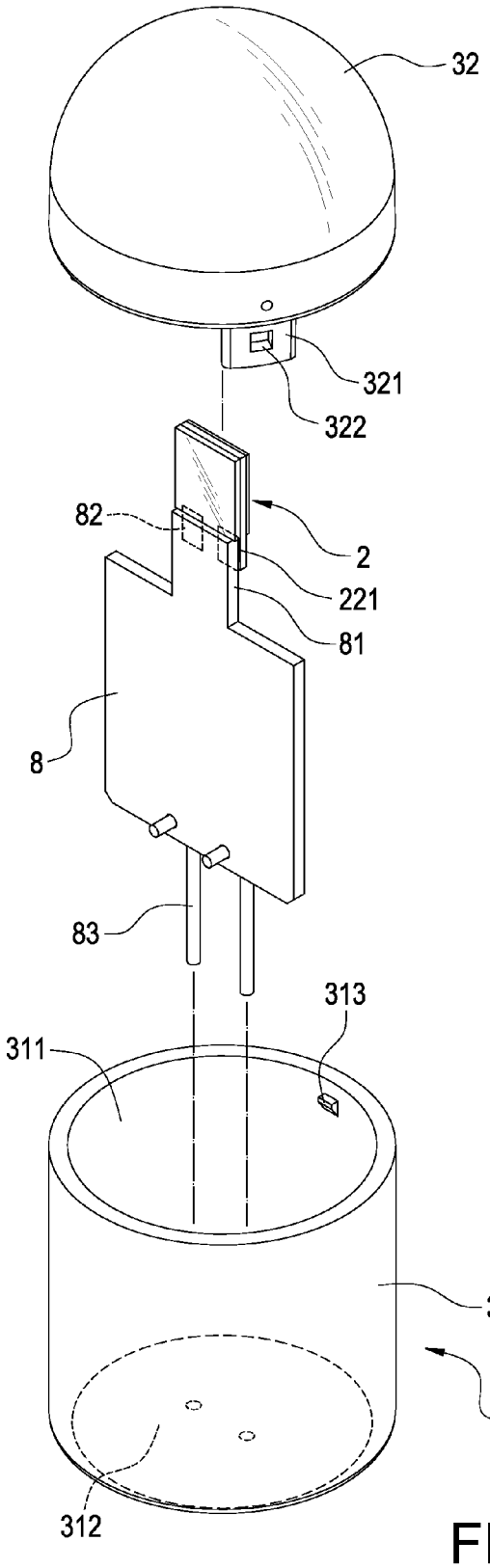
FIG. 15 is an exploded view of a light emitting diode bulb according to a sixth embodiment of the present invention.

Reference is made to FIG. 15, which is an explored view of a light emitting diode bulb according to a sixth embodiment of the present invention. The light emitting bulb is similar to the first embodiment mentioned above. The difference is that the driving circuit board 8 only includes one extending part 81 of strip shape or slice shape. A surface of the extending part 81 has two or more electrodes 82 for electrically connecting to three electrically connecting pads 221 of the lighting unit 2. The driving circuit board 8 includes a pair of electrically conductive pins 83 disposed on the other side opposite to the extending parts 81.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A light emitting diode bulb comprising:

a driving circuit board comprising one or more extending parts formed at one side of the driving circuit board and a group of electrically connecting pins disposed on the other side of the driving circuit board, one or more electrodes attached to one surface of each of the extending parts, and a driving circuit mounted on the driving circuit board;

a lighting unit electrically connected to the electrodes; and a housing packaging the driving circuit board and the lighting unit, and the electrically connecting pins extending beyond the housing, wherein the lighting unit comprises a transparent substrate, a circuit layer is attached to one surface of the transparent substrate and electrically connected to a plurality of light emitting diode dies, the circuit layer comprises two or more electrically connecting pads for electrically connecting to the electrodes.

2. The light emitting diode bulb in claim 1, wherein the transparent substrate comprises two opposite surfaces, one of the surfaces is covered with a first transparent sheet, and the other surface is covered with a second transparent sheet, the electrically connecting pads are exposed out of the first transparent sheet.

3. The light emitting diode bulb in claim 1, wherein a predetermined distance larger than or equal to a width of the lighting unit is between the two extending parts formed on the driving circuit board, the lighting unit is directly inserted between the extending parts, and the electrically connecting pads are electrically connected to the electrodes.

4. The light emitting diode bulb in claim 3, wherein the housing comprises:

an enclosure of U-shape or plate shape comprising an accommodating space, a group of penetrating holes, and at least one tenons, the accommodating space used for accommodating the driving circuit board, the penetrating holes allowing the electrically connecting pins passing therethrough, the tenon of hook shape formed on an inner wall of the enclosure; and a shell being of arc shape, cone shape or bullet shape and comprising an inner hollow cavity, a lower edge of the shell comprising at least one ledge, and an engaging part formed on the ledge for engaging with the tenon when the shell is assembled with the enclosure.

5. The light emitting diode bulb in claim 4, wherein the shell is made of plastic or acrylic.

6. The light emitting diode bulb in claim 5, wherein the enclosure is made of plastic or metal.

7. The light emitting diode bulb in claim 3, wherein the housing is of bullet shape and comprises a cylindrical enclosure and a shell of arc, cone, or inverse U-shape extending from the enclosure.

8. The light emitting diode bulb in claim 7, wherein the housing is made of silicone or epoxy.

9. The light emitting diode bulb in claim 8, wherein the housing further comprises a light-diffusing component.

10. The light emitting diode lamp bulb in claim 9, wherein the light-diffusing component is titanium dioxide or silicon dioxide.

* * * * *